US008336363B2

(12) United States Patent
Frattini

(10) Patent No.: US 8,336,363 B2
(45) Date of Patent: Dec. 25, 2012

(54) GRIPPING AND HANDLING DEVICE FOR METAL CONTAINERS

(75) Inventor: Roberto Frattini, Ponteranica (IT)

(73) Assignee: Frattini S.p.A. Costruzioni Meccaniche, Seriate (IT)

( * ) Notice: Subject to any disclaimer, the term of this patent is extended or adjusted under 35 U.S.C. 154(b) by 394 days.

(21) Appl. No.: 12/451,972

(22) PCT Filed: Jun. 13, 2007

(86) PCT No.: PCT/IT2007/000417

§ 371 (c)(1),
(2), (4) Date: Dec. 10, 2009

(87) PCT Pub. No.: WO2008/152661

PCT Pub. Date: Dec. 18, 2008

(65) Prior Publication Data

US 2010/0126245 A1 May 27, 2010

(51) Int. Cl.
*B21D 43/10* (2006.01)

(52) U.S. Cl. ..... 72/422; 72/94; 72/426

(58) Field of Classification Search ..... 72/257, 72/419, 422, 348, 426, 94; 269/21, 309; 294/99.1, 104, 106, 115, 64.2, 183, 116, 294/16, 28, 33, 87.1, 95, 94, 87.12, 100
See application file for complete search history.

(56) References Cited

U.S. PATENT DOCUMENTS

| | | | | |
|---|---|---|---|---|
| 2,147,366 | A * | 2/1939 | Fagan et al. | 141/13 |
| 3,245,436 | A * | 4/1966 | Burgert, Jr. | 141/165 |
| 3,967,847 | A * | 7/1976 | Ellis | 294/116 |
| 4,472,934 | A * | 9/1984 | Kriechbaum et al. | 57/275 |
| 4,604,043 | A * | 8/1986 | Pizzorno et al. | 425/182 |
| 5,456,325 | A * | 10/1995 | Pantermuehl et al. | 175/6 |
| 6,082,796 | A * | 7/2000 | Scaglia | 294/94 |
| 6,161,826 | A * | 12/2000 | Forrer | 269/309 |
| 6,193,211 | B1 * | 2/2001 | Watanabe et al. | 251/129.11 |
| 6,237,388 | B1 * | 5/2001 | McClung et al. | 72/361 |
| 6,375,240 | B1 * | 4/2002 | Lindberg | 294/183 |
| 6,439,559 | B1 * | 8/2002 | Kinnard et al. | 269/21 |
| 7,382,145 | B2 * | 6/2008 | Thurmaier | 324/756.04 |

FOREIGN PATENT DOCUMENTS

| | | |
|---|---|---|
| DE | 42 38 665 A1 | 5/1994 |
| IT | 1 216 844 B | 3/1990 |
| JP | 09 019731 A | 1/1997 |
| WO | WO 2006/069609 | 7/2006 |

* cited by examiner

*Primary Examiner* — Edward Tolan
*Assistant Examiner* — Homer Boyer
(74) *Attorney, Agent, or Firm* — Bucknam and Archer

(57) ABSTRACT

A device to grip and handle a metal container, obtained as an extruded, deep-drawn or deep-drawn/ironed metal rough piece, especially suitable for use on high-speed machines intended to perform, in a sequence, a plurality of mechanical working operations or other sort of working on the metal container, and including a first or lower portion that is fit to interface-connect the device to the machine both at the working stage and at the transfer stage of the high-speed machine from one working station to the one coming next, and a second or upper portion that is adapted for firmly gripping the metal container during the handling and the entire working sequence of working operations.

12 Claims, 3 Drawing Sheets

GRIPPING AND HANDLING DEVICE FOR METAL CONTAINERS

TECHNICAL FIELD

This invention refers to a gripping and handling device for a metal containers.

More particularly, this invention refers to a gripping and handling device for metal containers to be used, as a gripping means, especially in high-speed machines to perform a sequence of mechanical working operations, preferably along an extended portion of their side surface.

BACKGROUND ART

The metal containers that are handled by the device of this invention are made from metal extruded, deep-drawn or deep-drawn/ironed metal rough pieces, of aluminium, its alloys or other suitable materials; these containers, can be painted inside and/or outside and lithographed along the outer side surface before starting the sequence of operations that deform their external side surface These metal containers mainly undergo plastic deformation processes that are aimed at changing their geometrical structure in a partial manner (the so-called "necking" or "tapering" process), in a global manner (the so-called "shaping" process) or by making hollow or embossed shaped marks on pre-set portions of the side surface of the metal container ("embossing/debossing" process).

It is known that in high-speed machines, the metal container is transferred from one working tower or station to another in order to perform the sequence of working operations on its outer side surface.

The transfer stage of metal containers from one working station to the one coming next is particularly critical, since their transport system should allow a safe grip to avoid losing the container, but the grip also has to be sufficiently soft to avoid damaging the side surface of the metal container.

In metal container continuous-working machines, namely those working the above-described containers, in the shape of cans or "pop cans" and preferably addressed to the beverage market, the grip directly occurs along the cylindrical section of the side surface of the metal container, both at the transfer and the working stages, by means of slots or "pockets" wherein a vacuum degree is created such as to allow the above container to be gripped.

However, this type of grip for handling metal containers presents problems of great relevance.

During the transfer from one working station or tower to the one coming next, the metal container is diverted and secured for a short length on the working tower coming after the one that has been left, by means of special guides so as to allow the gripping means or "receiving pocket" to reach a sufficient vacuum degree. These guides come into contact with the side surface of the metal container, so as to produce some dragging that is likely to damage the side surface of the container.

A further problem stands in that the foregoing contacts or dragging, already hinted at above, tend to alter the angular position of the metal container; indeed, the angular position of the metal container as to its longitudinal axis is not controlled and may vary during the transfer from one working tower to the one coming next.

Another problem is that the gripping of the metal container strongly relies on the quality of the structure of its surface; an outer side surface bearing defects makes it difficult to high-speed handle the metal container due to "leaks" that reduce the vacuum degree grid, hence, the strength that may be exerted on the surface.

Another disadvantage stands in that the chance of losing/damaging the metal container during the transfer stage from one working station to the one coming next increases in proportion to the number of operations carried out on the container and, therefore, to the complexity of the shape achieved, since contact with the side surface of the container recurs at each transfer.

Further disadvantageous is that the described handling system only allows handling metal containers whose outer side surface presents an extensive cylindrical section, as the grip by the vacuum technique only proves to be effective if action is taken on an extended portion of the outer side surface of the metal container. This cylindrical segment must not be smaller than approximately 70÷80% the outer side surface of the metal container.

However, the market is currently oriented to the high-speed production of metal containers in the shape of "bottle cans" and/or "contour cans" that are machined on almost the entire outer side surface; these containers have a limited cylindrical length and demand, for their working, a large number of passages.

Accordingly, the vacuum gripping technology for the direct transfer of the metal container from one working station to the one coming next proves to be unsuitable to guarantee a safe, accurate and firm gripping of the container itself.

DISCLOSURE OF INVENTION

The object of this invention is to solve the foregoing problems.

More particularly, the object of this invention is to provide a device to grip and handle a metal container that is adapted to ensure a gripping that is safe as well as sufficiently soft over a limited length of its side surface, that is basically ranging between approximately 10 and 35 mm, and such as to avoid dragging and/or contacts with the metal container while it is being transferred from one working station to the one coming next.

A further object of this invention is to provide a device adapted to ensure that the metal container is accurately and coaxially positioned to the working equipment, and in addition is angularly balanced.

A further object of this invention is to provide a device that allows the size change-over to be rapidly and easily carried out depending on the type of metal container being worked.

Not last among the objects of this invention is the provision of a device equipped with an optimal gripping interface both during the transfer of the metal container and during its working, independent of the "size" or type of the metal container.

A further object of this invention is to provide the users of a metal container gripping and handling device that is such as to ensure a high level of resistance and reliability over time, and also such as to be easily and cheaply manufactured.

These and other objects are achieved by the metal container gripping and handling device of this invention, which includes a first or lower portion that can interface-connect the device with the machine both at the working stage and during the transfer of the container from one working station to the following one of the high-speed machine, and a second or upper portion that is such as to firmly grip the metal container during its handling and throughout the entire sequence of working actions.

BRIEF DESCRIPTION OF DRAWINGS

The structural and functional characteristics of the gripping and handling device of a metal container of this invention can be better understood from the detailed description that follows, wherein reference is made to the attached drawings that illustrate a preferential embodiment that is not meant to be restrictive, and wherein.

BEST MODE FOR CARRYING OUT THE INVENTION

Figure 1:
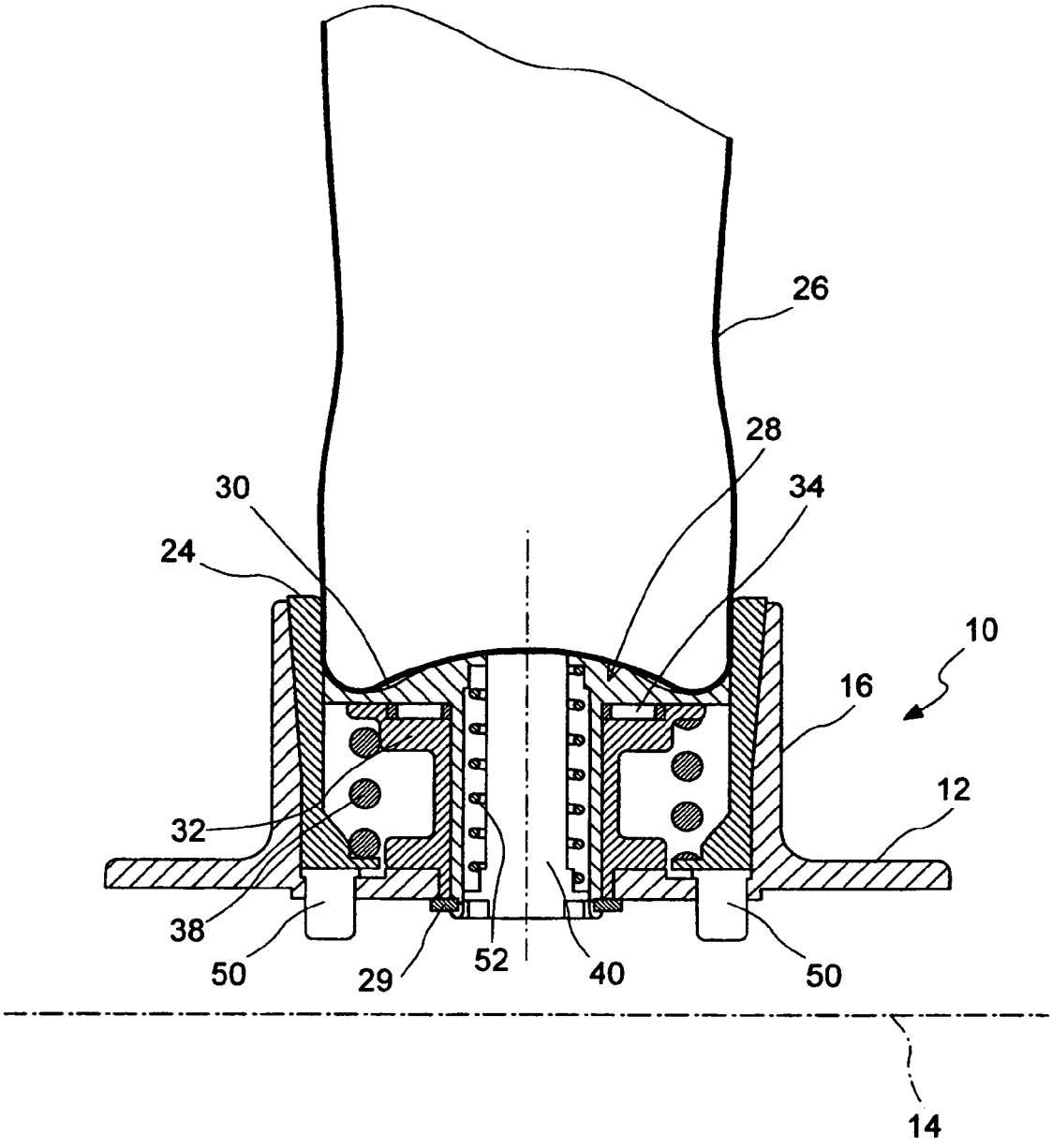
FIG. 1 schematically illustrates a longitudinal section view of a metal container gripping and handling device of this invention with the container being gripped.

With reference to the foregoing figures, the metal container gripping and handling device of this invention, generally marked, with 10, in FIG. 1, includes a body that is basically in the style of a "bucket", which is defined by a first or lower portion 12 basically circular in shape, of limited height and made of a metal material, such as aluminium, or a plastic material or any other suitable one. This lower portion 12 defines an active or interface functional surface of the device of this invention that interacts with each of the several part-bearing tables 14 of the machine for the deformation of metal containers.

This lower portion 12 presents at least one reference member, not shown in the figures, which is able to orient or balance the device of the invention as to the several part-bearing tables 14 of the high-speed machine.

The foregoing "bucket"-shaped body, starting from the central area of the upper front of the lower portion 12 as opposed to the part-bearing table 14, includes a second or upper portion 16 that develops, starting from the front-central area of the lower portion 12 and in the direction of the bottom of a metal container 26, into a ring expansion whose diameter is basically smaller than that of the lower portion itself.

The mentioned upper portion 16, which is made, like the lower portion 12, of a metal material or any other suitable one, is adapted to make up a seat that houses the items that will be described in full detail hereinafter.

In alternative embodiments, the upper portion 16 may be developed starting from the lower portion 12 with a diameter that basically matches that of the lower portion itself, or with a larger diameter.

The inner surface of the upper portion 16 preferably develops for a first section, basically equaling at least half the height of the upper portion itself, with a constant-diameter course, and for a second section with a course featuring progressively increasing diameters, in the direction of the bottom of the metal container 26, to define a taper whose function will be described in full detail hereinafter.

Inside the upper portion 16 and coaxially to it a snap ring 24 is located, whose height is basically the same as the height of the upper portion 16 and whose outer surface presents a taper that matches that of the inner surface of the upper portion itself.

The mentioned snap ring 24, slidingly arranged to the upper portion 16 as described hereinafter, is made of one sole piece or is defined by the assembly of two or more sectors; the same snap ring 24 is made of a plastic, metal or other suitable material and is meant to firmly receive and retain the metal container 26, inserted starting from its bottom.

Inside the snap ring 24 and coaxially to it there is a member 28, which is hollow in the centre, and whose upper portion turned to the bottom of the metal container 26 defines a disc 30 whose upper surface presents a concave shaping that reproduces, in a "negative" form, the development of the outer bottom surface of the metal container itself. The lower portion of this member 28 forms an appendage that is basically circular in section, in the opposite direction to the bottom of the metal container and towards the lower front of the lower portion 12 turned to the part-bearing table 14. This member 28 is bound to the lower portion 12 by means of retaining rings 29, for example a Seeger ring, or in another known manner.

The lower surface of the disc 30 of this member 28 bears on the upper front of a flanged sleeve 32 located inside the "bucket"-shaped body; in the region comprised between the lower surface of the disc 30 of the member 28 and the upper front of the sleeve 32, one or more bearings 34, typically of the axial type or of another known, type can be found, these being such as to allow the metal container to be oriented, as explained hereinafter.

The sleeve 32 is rigidly bound, in a known manner, to the lower portion 12 of the "bucket"-shaped body.

A return member, typically at least one spring 38, preferably helical in type or of another known sort, is arranged on the outside of the sleeve 32 and coaxially to it.

A stem 40 is inserted in a coaxial position as to the sleeve 32 and to the member 28; on the outside of the stem 40 and coaxially to it there is at least a further return member, defined for instance by at least a further spring 52 of helical type or of another known sort and adapted to serve the function that will be described hereinafter.

The snap ring 24 is moved in the axial direction by means of an actuating means (not shown in the figures), which exerts a thrusting action on the lower front of the snap ring, opposed to the upper front of insertion of the metal container, e.g. by means of two or more pins 50 that slide axially as to the lower front of the lower portion 12; this actuating means co-operating with the above-mentioned spring 38.

It has to be noticed that the lower portion 12 is dimensioned absolutely independently of the metal container 26 and is the same for the various types of metal containers. Differently the other members building the device of the invention, such as the snap ring 24 and the disc 30 of the member 28 are manufactured based on the specific geometrical characteristics of the metal container that has to be worked.

Even the upper portion 16 can be dimensioned absolutely independently of the size of the metal container that has to be worked.

Here follows an explanation of how the metal container gripping and handling device of this invention, which has been described in details above in its component parts and with reference to a preferential embodiment, operates.

The operation of such a device basically comprises three stages:

- an insertion stage, at the process start, of the metal container 26, that is the first stage of relative movement between the metal container and the device of this invention;
- an active or transfer stage, when the process is in progress; that is the stage when the metal container 26 is rigidly gripped and stabilized as to the device of the invention and during which the transfer and working of the container takes place;
- an extraction stage, at the end of the process, that is the stage when the relative dragging movement takes place and when the container 26 moves away from the device of this invention.

When the metal container 26 has not yet been inserted into the device, the device of this invention is preferably in the "close" configuration state in order to actively prevent any undesired opening of the device due to disturbing phenomena such as vibration or the like.

Figure 2:
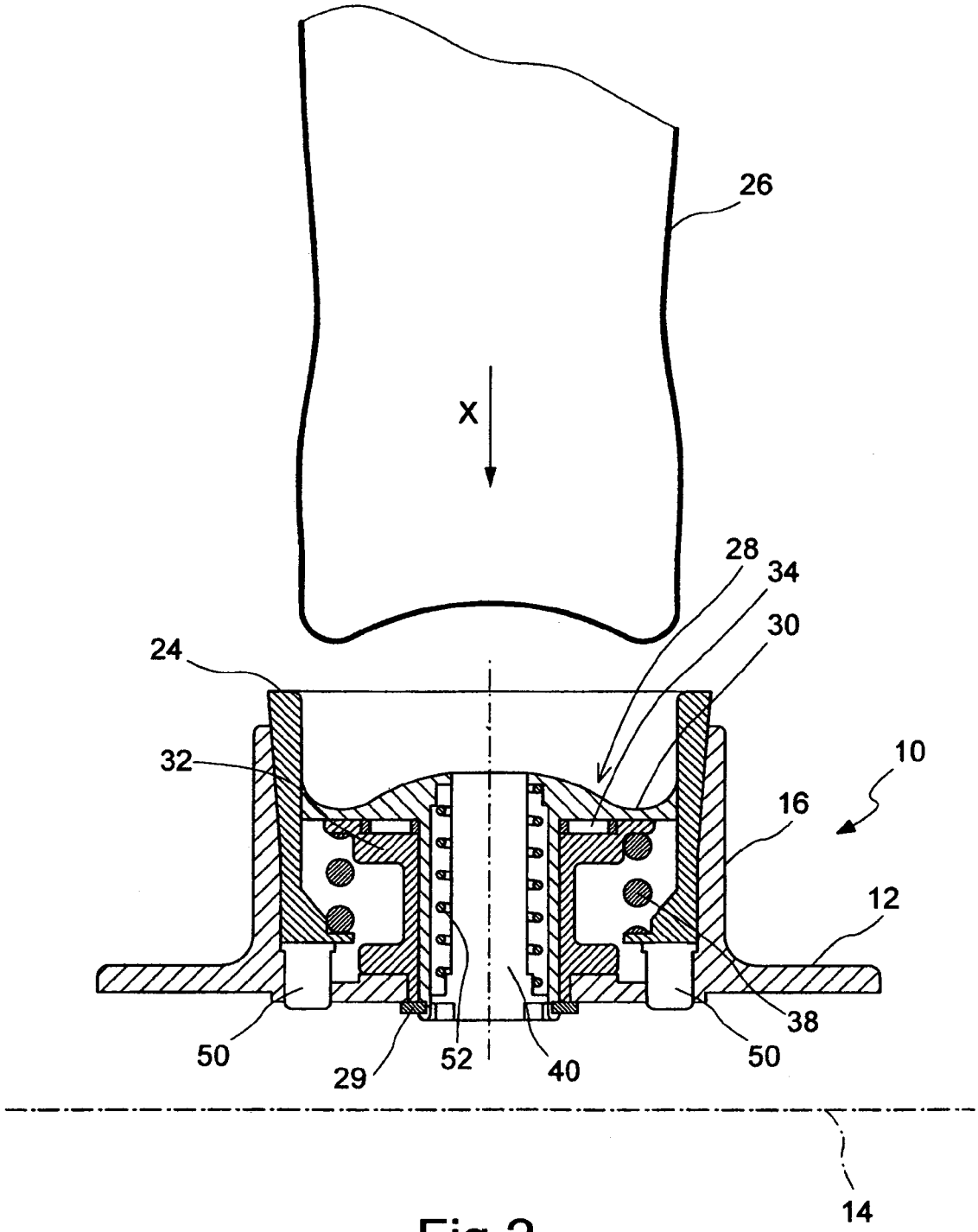
FIG. 2 schematically illustrates a longitudinal section of the device of this invention at an operating stage when the metal container is inserted into the device.

The insertion of the metal container 26 is carried out as schematised in FIG. 2, wherein the device of this invention is depicted in the "open" configuration state.

In order to open the device of this invention and to be able to insert the metal container 26, the actuating means (not shown) located next to the table-bearing 14 exerts a thrusting action on the snap ring 24 which compresses the spring 38 and simultaneously moves forwards in the axial direction. While sliding, due to the taper of its outer side surface and to that of the inner side surface of the upper portion 16, this snap ring 24 moves forward in the direction of the bottom of the metal container 26 and, after losing contact with the tapered inner side surface of the upper portion 15, expands radially. With the device of this invention in the "open" configuration, the metal container 26 is inserted according to the direction marked by the arrow "X" and next to its bottom; the convex peripheral portion of the bottom of the metal container leads to contact with the shaping of the upper surface of the disc 30 of member 28.

At this stage, the metal container 26 can be adapted to a possible orientation in the device of the invention by means of one or more bearings 34 of the sleeve 32.

The same device of this invention is possibly oriented or phased to the table-bearing table 14, for instance by means of at least one reference member, not shown in the figures, and to which reference has been made above.

With the metal container thus arranged, the actuating means (not shown) returns to the stop position and, hence, the spring 38, previously compressed, flexibly returns the snap ring 24 in the direction of the lower portion 12; in these conditions, the device of this invention stands in the "closed" configuration which, as already said before, is the stop configuration of this device.

As schematised in FIG. 1, the metal container 26 is stabilized to the device of the invention with a safe and firm grip performed along a limited length of its side surface, which basically ranges between 10 and 35 mm.

Figure 3:
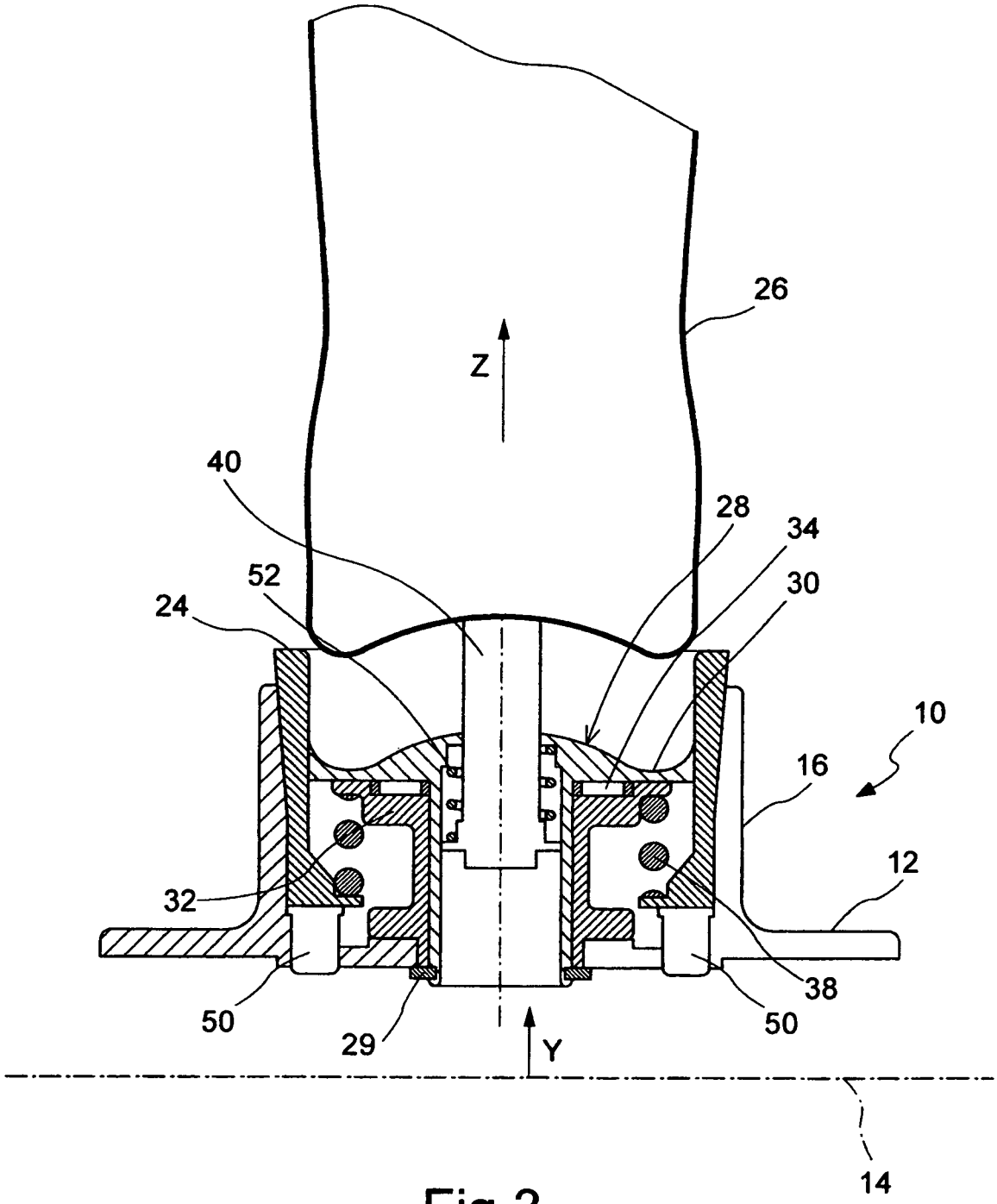
FIG. 3 schematically illustrates a longitudinal section of the device of this invention at an operating stage when the metal container is released from the device.

FIG. 3 is a schematic representation of the release or extraction stage of the metal container 26 from the device of this invention at the end of the surface buckling stage of the container.

At this stage, the device of this invention shifts from the "closed" to the "open" configuration, as already indicated before, and simultaneously causes the metal container, to be released from the snap ring 24.

To achieve the release or extraction of the metal container 23 from the snap ring 24, a further actuating means (not shown in the figures) exerts a thrusting action, according to the direction marked by the arrow "Y", on the lower base of the stem or extraction pin 40 that presses against the bottom of the metal container 26 and thus performs its extraction according to the direction marked by the arrow "Z" in FIG. 3.

INDUSTRIAL APPLICABILITY

As one may deduce from the foregoing description, the advantages brought about by the invention are obvious.

The metal container gripping and handling device advantageously defines a mechanical device that grips the container, in a safe as well as sufficiently soft manner, along a limited length of its outer side surface, so as to allow the working of containers of the "bottle can" and/or "contour can" type to be carried out.

The metal container and the device of this invention become integral with one another within the working process; suitable surfaces of the device manage all contacts and/or dragging while the metal container is being transferred from one working tower, or station to the one coming next, thus holding integral the side surface of the container.

As a matter of fact, this, device presents an interface to allow the metal container holding, an interface to undergo a safe mechanical grip of the device itself during its transfer, and a further, to ensure the correct positioning and orientation during the working stage. These interfaces can be advantageously made of a high-resistance material so as to also be able to act on them with great forces.

A further advantage stands in that the interaction between the device of this invention and the metal container only takes place at the starting (insertion) and final (extraction) process stages, independent of the structural complexity of the metal container; during the working stages, the metal container is firmly arranged to the device of this invention.

A further advantage stands in that the portion of device of this invention that engages the part-bearing table, that is the lower portion 12, is common to all types of metal containers and is such as not to require the geometrical characteristics of the working stations to be changed, with an ensuing saving in terms of retooling and maintenance costs.

Although the foregoing invention has been described by making special reference to a preferential embodiment, which is only provided as an illustration and is not meant to be restrictive in character, many variations and changes will be obvious to anybody skilled in the art in the light of the foregoing disclosure. Hence, this invention is intended to include all those changes and variations that fall within the spirit and the protective scope of the attached claims.

The invention claimed is:

1. A device (10) for gripping and handling a metal container (26), said container (26) being obtained from an extruded, deep-drawn or deep-drawn/wire-drawn metal rough piece, said device (10) being suitable for use with a high speed metal container deformation machine for performing a plurality of mechanical working sequences on the metal container (26), said device (10) including:

a) a first lower portion (12) adapted to interface-connect said device (10) to said high speed metal container deformation machine during the performance of the plurality of working sequences and during high speed transfer stages from one work station to the next of said machine; and b) a second upper portion (16) including a retaining means adapted to mechanically firmly grip and stabilize said metal container (26) during the plurality of working sequences and high speed transfer stages of said metal container deformation machine, wherein said upper portion (16) has an interior with an inner surface having a diameter that progressively increases in the direction from the bottom of said metal container (26) toward the open top of the upper portion so as to define a taper for receiving said retaining means and to permit axial movement of said retaining means relative to the interior of said upper portion (16).

2. The device according to claim 1, wherein said lower portion (12) includes at least one reference member for the correct positioning/balancing of the device relative to a part bearing table (14) of said high speed metal container deformation machine.

3. The device according to claim 1, wherein said axially movable retaining means comprises a snap ring (24) axially arranged within said upper portion (16).

4. The device according to claim 3, wherein said snap ring (24) has an outer surface tapered to match the taper of the inner surface of said upper portion (16).

5. The device according to claim 3, wherein said snap ring (24) grips and stabilizes said metal container (26) along a limited length of a side surface of the metal container ranging from 10 to 35 mm.

6. The device according to claim 3, wherein said snap ring (24) is axially moved by an actuating means which cooperates with a return member to exert a thrusting action on a lower front of said snap ring opposed to an upper front of insertion of said metal container (26) into said snap ring.

7. The device according to claim 6, wherein said return member is a spring (38).

8. The device according to claim 3, which further includes a member (28) arranged coaxially within said snap ring (24), said member (28) having a hollow center and an upper portion defining a concave shaped disk (30).

9. The device according to claim 8, which further includes a stem (40) disposed in the hollow center of said member (28) and coaxial thereto which functions to extract the metal container (26) from said snap ring (24).

10. The device according to claim 9, wherein said stem (40) extracts the metal container (26) from said snap ring (24) by the axial movement of said stem in said snap ring so as to push said metal container from said snap ring, said stem movement being activated by actuating means cooperating with a stem return member.

11. The device according to claim 10, wherein said stem return member comprises a spring (52).

12. The device according to claim 8, which further includes a bearing (34) disposed between a lower surface of said concave shaped disk (30) and an upper front of a sleeve (32) within which said member (28) is disposed, thereby allowing the metal container (26) disposed on said disk (30) to be oriented in said device.

* * * * *